US007711298B2

(12) United States Patent
Whitney et al.

(10) Patent No.: US 7,711,298 B2
(45) Date of Patent: May 4, 2010

(54) METHODS AND DEVICES TO TRANSFER TONER IN AN IMAGE FORMING DEVICE TO CONTROL CHARGE BUILDUP ON A TONER IMAGE

(75) Inventors: Julie Ann Gordon Whitney, Georgetown, KY (US); Rachel Doris Rieck, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/946,487

(22) Filed: Nov. 28, 2007

(65) Prior Publication Data

US 2009/0136272 A1 May 28, 2009

(51) Int. Cl.
*G03G 15/06* (2006.01)

(52) U.S. Cl. ..... 399/302; 399/308

(58) Field of Classification Search ..... 399/55, 399/66, 302, 308, 303
See application file for complete search history.

(56) References Cited

U.S. PATENT DOCUMENTS

| | | | | |
|---|---|---|---|---|
| 6,324,359 | B1 * | 11/2001 | Nakane | 399/66 |
| 2003/0198492 | A1 * | 10/2003 | Takenaka | 399/313 |
| 2005/0084301 | A1 * | 4/2005 | Murakami et al. | 399/313 |
| 2006/0210327 | A1 * | 9/2006 | Iwakura et al. | 399/313 |
| 2007/0183816 | A1 * | 8/2007 | Hatayama et al. | 399/299 |
| 2007/0189791 | A1 * | 8/2007 | Mohri | 399/50 |
| 2007/0269241 | A1 * | 11/2007 | Sawai et al. | 399/299 |

FOREIGN PATENT DOCUMENTS

JP 2003035986 A * 2/2003

* cited by examiner

*Primary Examiner*—Quana M Grainger

(57) ABSTRACT

The present application is directed to methods and devices for controlling charge buildup on a toner image as the toner image passes through one or more transfer nips. Charge buildup may be reduced by laterally offsetting a transfer roller from a photoconductor drum. The transfer roller may be constructed of an essentially non-compressible conductive material. AC current may be used to generate an electrical field between the photoconductor drum and the transfer roller.

20 Claims, 7 Drawing Sheets

METHODS AND DEVICES TO TRANSFER TONER IN AN IMAGE FORMING DEVICE TO CONTROL CHARGE BUILDUP ON A TONER IMAGE

BACKGROUND

The present application relates generally to electrophotographic image forming devices, and in particular to a toner transfer apparatus to control charge buildup in a toner image as the toner image passes through one or more image transfer stations.

Electrophotographic image forming devices, such as laser printers, facsimile machines, copiers, all-in-one devices, etc, are well known in the art. Color electrophotographic image forming devices may form a plurality of latent electrostatic images, develop each color plane image with toner particles, and ultimately transfer the color plane images to a media sheet and then fuse them to the media sheet using heat and pressure. Color electrophotographic image forming devices may be divided into two types by considering how toner is transferred to the media sheet. In a direct to media (DTM) type image forming device, the developed toner image of each color plane is successively transferred directly to the media sheet. In an intermediate transfer mechanism (ITM) type image forming device, the developed toner image of each color plane is successively transferred to an intermediate transfer mechanism, such as a belt, and then the full-color image is transferred to a media sheet at a secondary transfer location.

One known problem that particularly affects ITM type image forming devices is charge buildup on the developed toner on the ITM as the toner passes successively through high-voltage image transfer stations. Toner which has passed through multiple image transfer stations may be at a different charge than toner which has not passed through any additional image transfer stations. When the toner image is transferred to the media sheet at the secondary transfer location, the toner that is less charged may transfer at a lower voltage than more highly charged toner. In order to transfer the entire toner image, a voltage high enough to affect the transfer of the most highly charged toner is used. High transfer voltages may create a phenomenon known as Paschen breakdown. In Paschen breakdown, toner particles reverse polarity and their placement becomes unpredictable. The toner particles may even backtransfer from the media sheet to the ITM. Backtransfer detrimentally impacts image quality.

SUMMARY

The present application is directed to methods and devices to transfer toner in an image forming device to control charge buildup on a toner image as the toner image passes through one or more transfer nips. Charge buildup may be reduced by laterally offsetting a transfer roller from a photoconductor drum. The transfer roller may be constructed of an essentially non-compressible conductive material. AC current may be used to generate an electrical field between the photoconductor drum and the transfer roller.

DETAILED DESCRIPTION

The present application is directed to methods and devices to transfer toner in an image forming device to control charge buildup on a toner image as the toner image passes through one or more transfer nips. Each transfer nip is comprised of a photoconductor drum and a transfer roller positioned on opposite sides of an intermediate transfer member. In one embodiment, the transfer roller is offset from the photoconductor drum such that the point where the photoconductor drum contacts the intermediate transfer member is laterally offset from the point where the transfer roller contacts the intermediate transfer member. AC current may be used to generate an electrical field between the photoconductor drum and the transfer roller.

Figure 1:
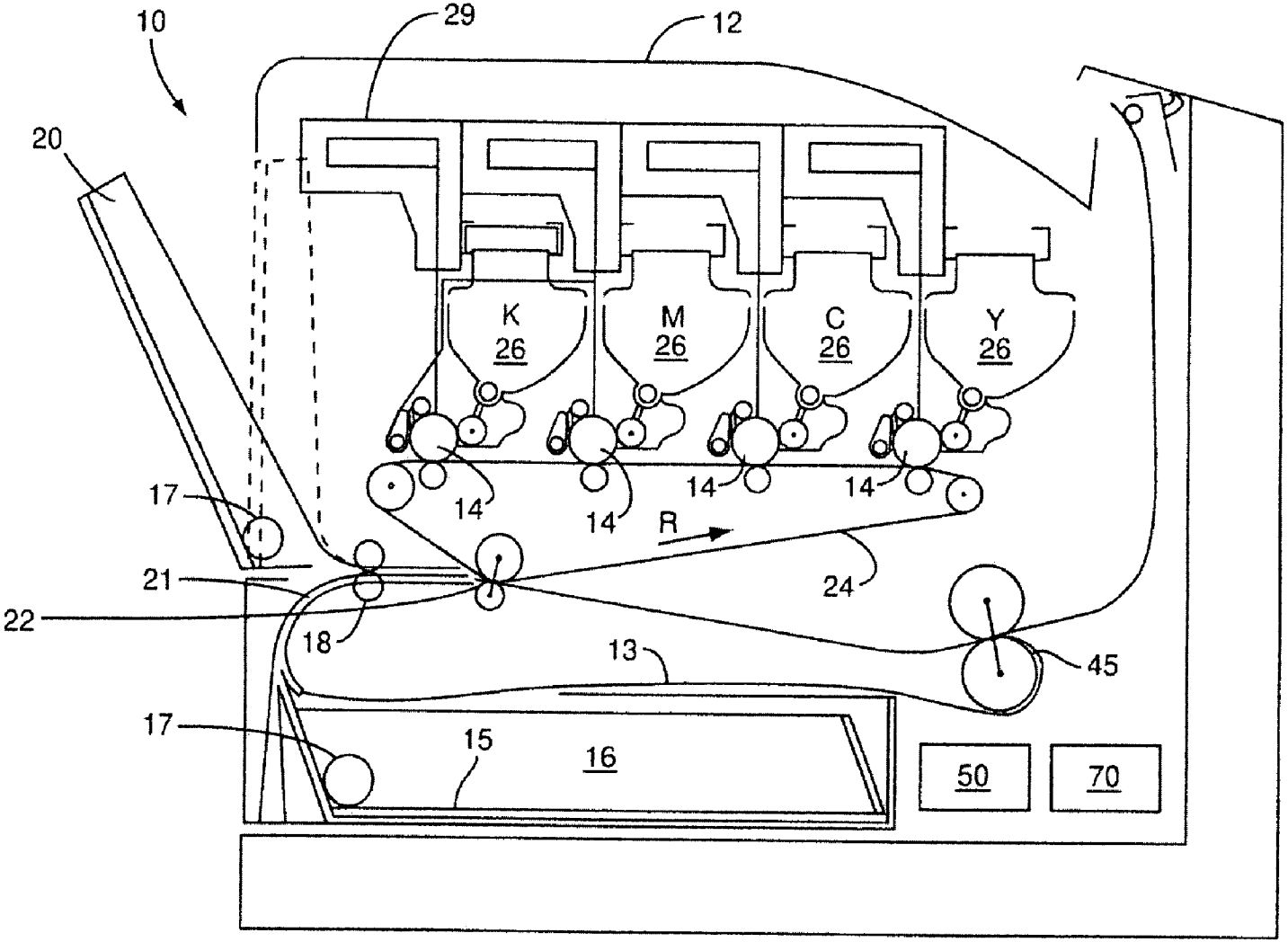
FIG. 1 is a schematic diagram of an image forming device according to one embodiment.

To understand the workings and context of the present application, FIG. 1 depicts a representative image forming device, indicated generally by the numeral 10. The image forming device 10 comprises a main media sheet stack 16. Within the image forming device body 12, the image forming device 10 may include a plurality of removable image formation cartridges 26, each with a similar construction but distinguished by the toner color contained therein. In one embodiment, the image forming device 10 includes a black cartridge (K), a magenta cartridge (M), a cyan cartridge (C), and a yellow cartridge (Y). Each cartridge 26 forms an individual monocolor image that is combined in layered fashion with images from the other cartridges 26 to create the final multi-colored image. The image forming device 10 may further include an intermediate transfer mechanism (ITM) 24, one or more imaging devices 29, and a fuser 45. A controller 50 may oversee operation of the image forming device 10.

The operation of the image forming device 10 is conventionally known. Upon command from the controller 50, the media sheet 15 is "picked," or selected, from either the primary media stack 16 by a pick roller 17 and conveyed into a media feed path 21 or introduced through a manual input 20 into the media feed path 21. Regardless of its source, the media sheet 15 is transported to drive rollers 18, and then to a secondary transfer location 22 to receive a toner image from the ITM 24. In this embodiment, ITM 24 is an endless belt that rotates in the direction indicated by arrow R around a series of rollers adjacent to photoconductor drums 14 of the respective image formation cartridges 26. Toner is deposited from each photoconductor drum 14 as needed to create a full color image on the ITM belt 24. The deposited toner is transferred from the ITM belt 24 to the media sheet 15 at the secondary transfer location 22. The media sheet 15 and attached toner next travel through a fuser 45 having a pair of rollers and a heating element that heats and fuses the toner to the media sheet 15. The media sheet 15 with fused image is then transported out of the printer body 12 for receipt by a user. Alternatively, the media sheet 15 is moved through a duplex path 13 for receiving an image on a second side.

The image forming device 10 may include one or more power supplies, indicated generally by reference number 70 in FIG. 1. The power supply 70 may provide the voltage necessary to electronically bias the photoconductor drums 14 to receive toner. The power supply 70 may also provide voltage to electrically bias charging units 31, developer rollers 32, and transfer rollers 34 as described in more detail below. The power supply 70 may include more than one power supply 70, and may include at least one AC power supply 70 and/or at least one DC power supply 70.

Figure 2:
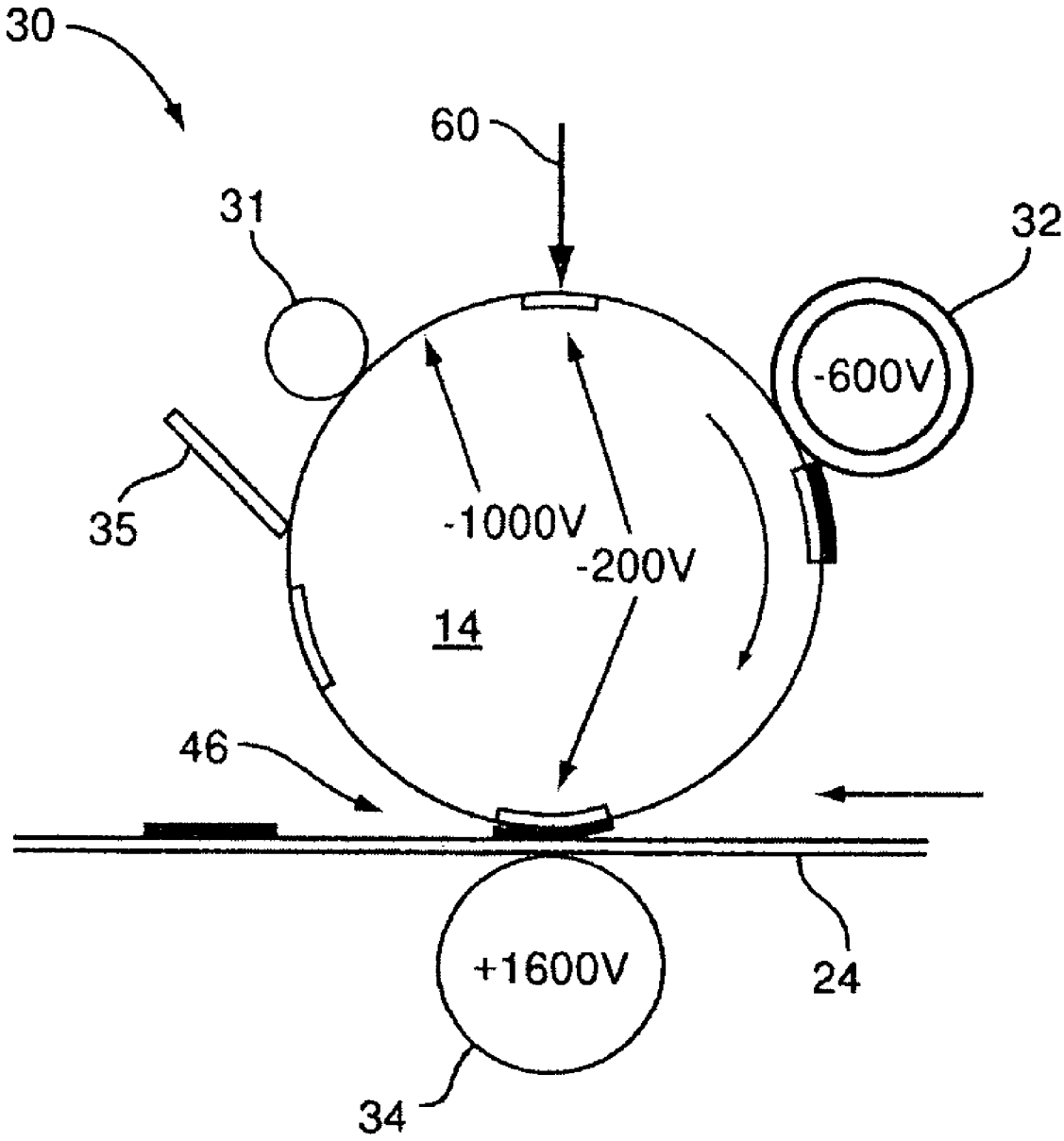
FIG. 2 (PRIOR ART)
FIG. 2 is schematic diagram of a prior art image transfer station.

FIG. 2 is a schematic diagram illustrating an exemplary prior art image transfer station 30. Each image transfer station 30 may include the photoconductor drum 14, the charging unit 31, the developer roller 32, the transfer roller 34, and a cleaning blade 35. The photoconductor drum 14 is a cylindrically shaped roller and illustrated in this embodiment as a drum. However, it will be apparent to those skilled in the art that the photoconductor drum 14 may comprise any appropriate structure. The charging unit 31 charges the surface of the photoconductor drum 14 to a generally uniform negative potential, such as approximately −1000 volts (V). A laser beam 60 from the imaging device 29 (see FIG. 1) selectively discharges areas on the photoconductor drum 14 to form a latent image on the surface of the photoconductor drum 14. The areas of the photoconductor drum 14 illuminated by the laser beam 60 are discharged, resulting in a potential of approximately −200V. The transfer roller 34 is charged to an appropriate positive potential, such as +1600 V. The potential of the transfer roller 34 may vary depending on the type and age of the ITM belt 24, the electrical or other property of the toner being applied to the ITM belt 24, environmental conditions, and other factors.

As illustrated in FIG. 2, the photoconductor drum 14 is disposed on one side of the ITM belt 24, and the transfer roller 34 is disposed directly opposed to the photoconductor drum 14 on an opposite side of the ITM belt 24 such that the ITM belt 24 is pressed between the photoconductor drum 14 and the transfer roller 34. A transfer nip 46 is formed where the photoconductor roller 14 and the transfer roller 34 contact the ITM belt 24. At the transfer nip 46, the transfer roller 34 urges the ITM belt 24 into contact with the photoconductor roller 14 to facilitate transfer of the toner onto the ITM belt 24.

The developer roller 32 transports negatively-charged toner to the surface of the photoconductor drum 14, to develop the latent image on the photoconductor drum 14. The developer roller 32 core is held more negatively charged that the discharged areas of the photoconductor drum 14. The toner is attracted to the most positive surface, i.e., the area discharged by the laser beam 60 and is repelled by more-negatively charged areas of the photoconductor drum 14 (i.e. those not optically discharged). As the photoconductor drum 14 rotates, a positive voltage field produced by the transfer roller 34 attracts and transfers the toner adhering to the discharged areas on the surface of the photoconductor drum 14 to the ITM belt 24. Any remaining toner on the photoconductor drum 14 is then removed by the cleaning blade 35. The toner thus may experience a relative potential difference of 400 V between the developer roller 32 and the photoconductor drum 14, and a potential difference of 1800 V between the photoconductor drum 14 and the transfer roller 34.

Figure 3:
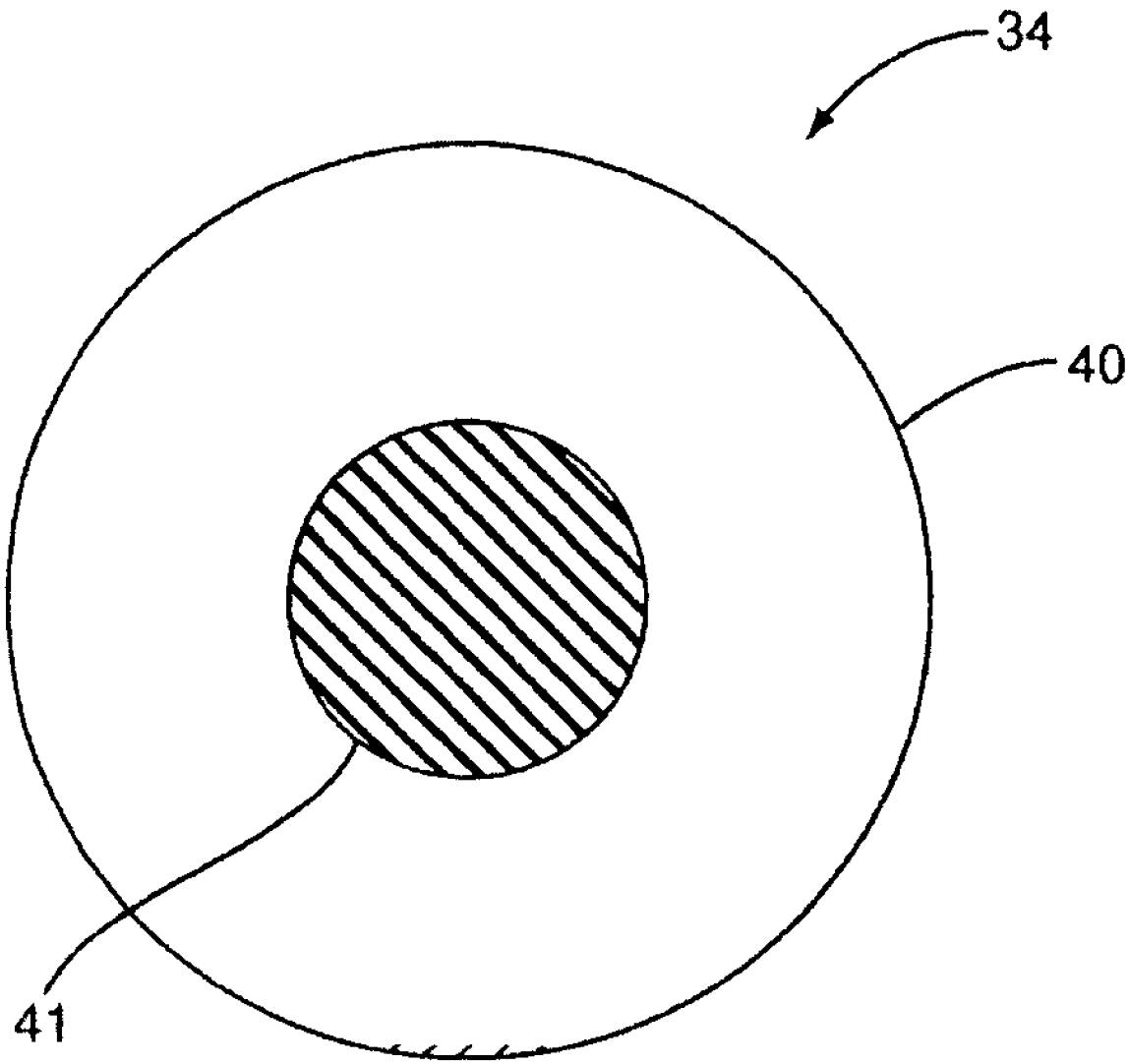
FIG. 3 (PRIOR ART)
FIG. 3 is a cross-sectional view of a prior art transfer roller.

FIG. 3 illustrates a cross-sectional view of the prior art transfer roller 34. The transfer roller 34 may be comprised of a resilient (e.g., foam or rubber) outer surface 40 disposed around a conductive axial shaft 41. The transfer roller 34 is able to produce the positive voltage field due to the high resistivity of the outer surface 34 relative to the shaft 41, ITM belt 24, and photoconductor drum 14.

The image transfer process is complex and is sensitive to many inputs. The operating environment (temperature, humidity, and the like), ITM belt 24 properties, photoconductor drum 14 characteristics, toner formulation, and other factors all influence image quality. All of these inputs may directly impact the electrical potential across toner transfer boundaries in an image transfer station 30. In particular, the resistivity of the toner gives rise to the toner collecting charge as it progresses through downstream image transfer stations 30.

Figure 4:
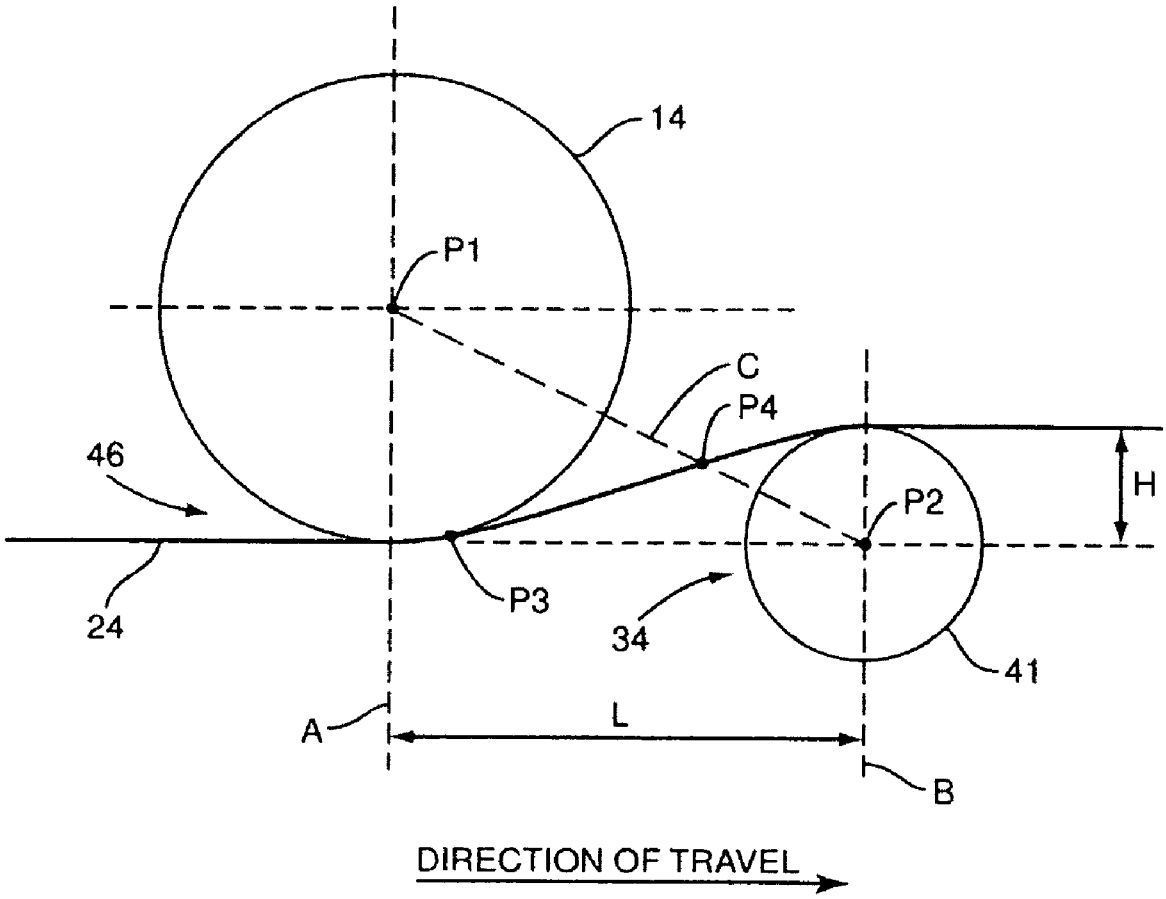
FIG. 4 is a schematic diagram of a photoconductor drum and a transfer roller according to one embodiment.

In order to reduce toner charge buildup, one embodiment of the present application as illustrated in FIG. 4 includes the transfer roller 34 comprised of the conductive axial shaft 41 without the resilient outer surface 40 of the prior art transfer roller 34. In one embodiment, the transfer roller 34 is constructed of an essentially non-compressible conductive material. In one embodiment, the transfer roller 34 includes a uniform cross-sectional composition.

Figure 5A:
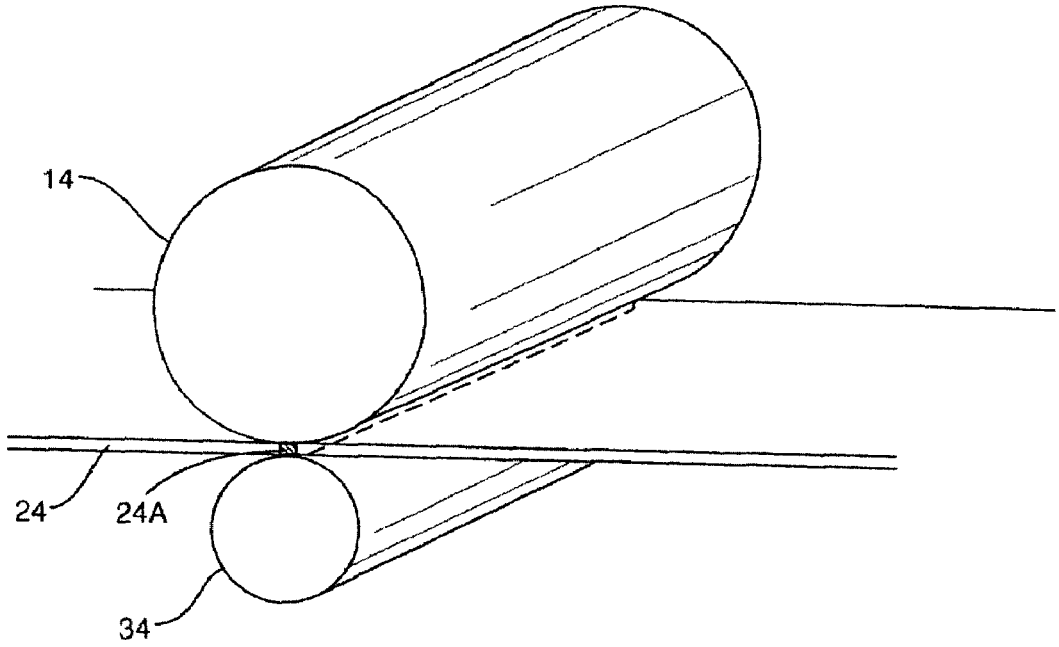
FIG. 5A (PRIOR ART)
FIG. 5A is a perspective view of a prior art arrangement of a photoconductor drum and a transfer roller.

With the resilient outer surface 40 absent, the ITM belt 24 now controls the resistivity of an electrical path from the transfer roller 34 to the photoconductor drum 14. If the positioning of the photoconductor drum 14 and the transfer roller 34 in this embodiment was the same as that illustrated in FIG. 2 (i.e., directly opposed to one another), then the electrical path between the photoconductor drum 14 and the transfer roller 34 may pass through a relatively small volume of the ITM belt 24. Consequently, the electrical path may have less resistivity than the resilient outer surface 40 of the prior art transfer roller 34. This is illustrated by the shaded section 24A of the ITM belt 24 in FIG. 5A. Section 24A is the section of the ITM belt 24 that the electrical current may pass through in the electrical path between the transfer roller 34 and the photoconductor drum 14. Because the section 24A of the ITM belt 24 is narrow, the transfer voltage required to transfer the toner from the photoconductor drum 14 to the ITM belt 24 may primarily be a function of a surface resistivity value of the ITM belt 24.

In the embodiment of FIG. 4, however, the transfer roller 34 is laterally offset from the photoconductor drum 14 such that the transfer roller 34 is not directly opposed to the photoconductor drum 14. The lateral offset is designated by L in FIG. 4. The lateral offset L is defined as the lateral distance in the direction of travel of the ITM belt 24 between the point where the photoconductor drum 14 contacts the ITM belt 24 and the point where the transfer roller 34 contacts the ITM belt 24. Stated another way, the lateral offset L is the lateral distance between a line passing through a center point of the photoconductor drum 14 and orthogonal to the ITM belt 24 (broken line A in FIG. 4) and a line passing through a center point of the transfer roller 34 and orthogonal to the ITM belt 24 (broken line B in FIG. 4).

FIG. 4 further illustrates the degree of lateral offset L between the transfer roller 34 and the photoconductor drum 14. The lateral offset L may be sufficient to position the transfer roller 34 apart from the photoconductor drum 14 such that the point where the transfer roller 34 contacts the ITM belt 24 (the point where broken line B intersects the ITM belt 24) is further downstream than a most downstream point P3 of the ITM belt 24 in contact with the photoconductor drum 14. The lateral offset L may be further illustrated by drawing a line between a center point P1 of the photoconductor roller 14 and a center point P2 of the transfer roller 34 (broken line C in FIG. 4). Line C intersects the ITM belt 24 at point P4. Point P4 is further downstream than the most downstream point P3 of the ITM belt 24 in contact with the photoconductor drum 14.

Because of the lateral offset L, the ITM belt 24 is not pressed between the photoconductor drum 14 and the transfer roller 34.

The transfer roller 34 may be laterally offset from the photoconductor drum 14 in either an upstream or downstream direction. All of the transfer rollers 34 may be offset in the same direction (either all upstream or all downstream), or the transfer rollers 34 may have a mixture of offsets. For example, the first transfer roller 34 may be offset downstream from the first photoconductor drum 14, and the remaining transfer rollers 34 offset upstream for the photoconductor drums 14. When the transfer roller 34 is offset downstream from the photoconductor drum 14 as illustrated in FIG. 4, the ITM belt 24 contacts the photoconductor drum 14 prior to contacting the transfer roller 34. In the upstream offset configuration (effectively reversing the direction of travel of the ITM belt 24 from that illustrated in FIG. 4), the ITM belt 24 contacts the transfer roller 34 prior to contacting the photoconductor drum 14.

Figure 5B:
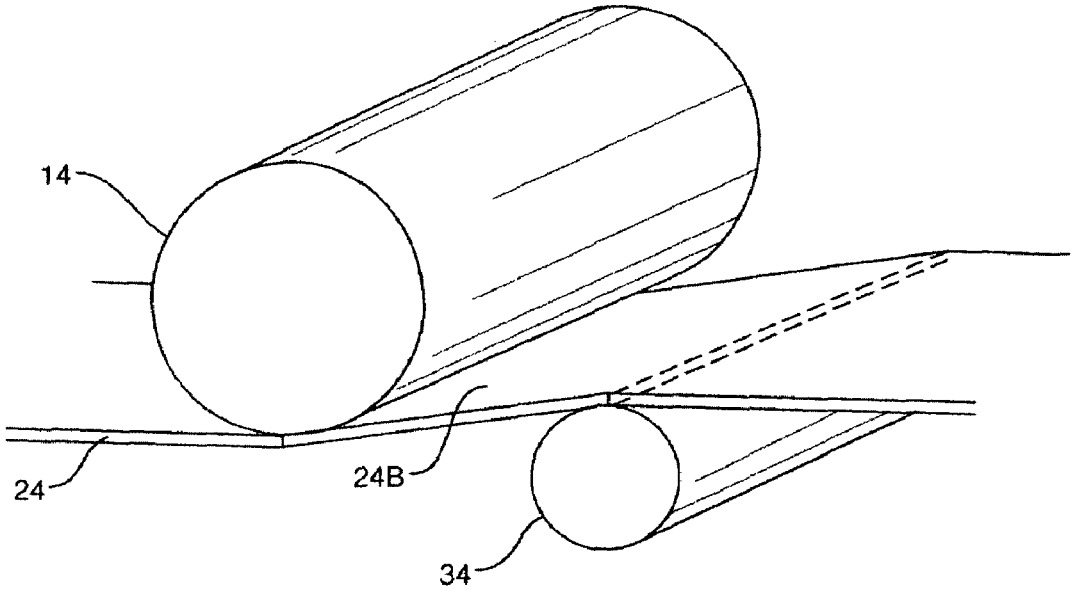
FIG. 5B is a perspective view of a photoconductor drum and a transfer roller according to one embodiment.

In one embodiment, the lateral offset L is 20 mm. As illustrated in FIG. 5B, the electrical path now has a larger section 24B of the ITM belt 24 to pass through. The transfer voltage may now be a function of both the surface resistivity and the volume of the ITM belt 24 the electrical path passes through (i.e., a surface resistivity of the ITM belt 24). Section 24B may provide greater resistivity than section 24A of the ITM belt 24, resulting in a higher transfer voltage.

The prior art transfer roller 34 illustrated in FIG. 3 may not allow the use of AC current for the transfer voltage. The resilient outer surface 40, due to its resistivity, causes a time delay along a current path from the conductive axial shaft 41 through the resilient outer surface 40. This time delay may tend to damp out higher frequency oscillations of the AC current.

In one embodiment of the present application, AC current may be used for the transfer voltage. There may be less time delay in the current path through section 24B of the ITM belt 24, resulting in little or no damping of the higher oscillations of the AC current. AC current is desirable for toner transfer because it enhances the transfer operation. The oscillating nature of the AC current first loosens some of the toner particles from the photoconductor drum 14. As the voltage of the AC current begins to reverse, loose toner particles are drawn back to the photoconductor drum 14 and collide with toner particles remaining on the photoconductor drum 14. The collisions provide a mechanical force to loosen the toner particles, resulting in a lower voltage potential to affect transfer of the toner to the ITM belt 24.

Figure 6A:
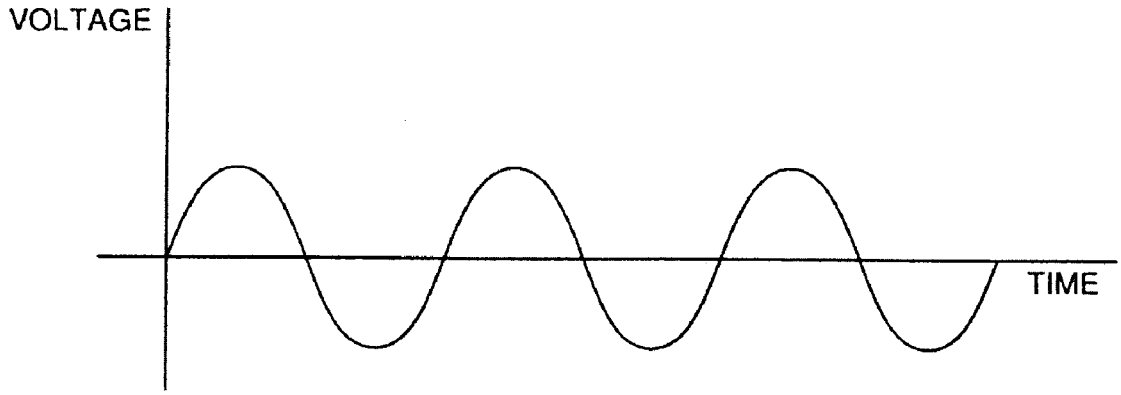
FIG. 6A is a graphical representation of an AC current without a DC offset according to one embodiment.
Figure 6B:
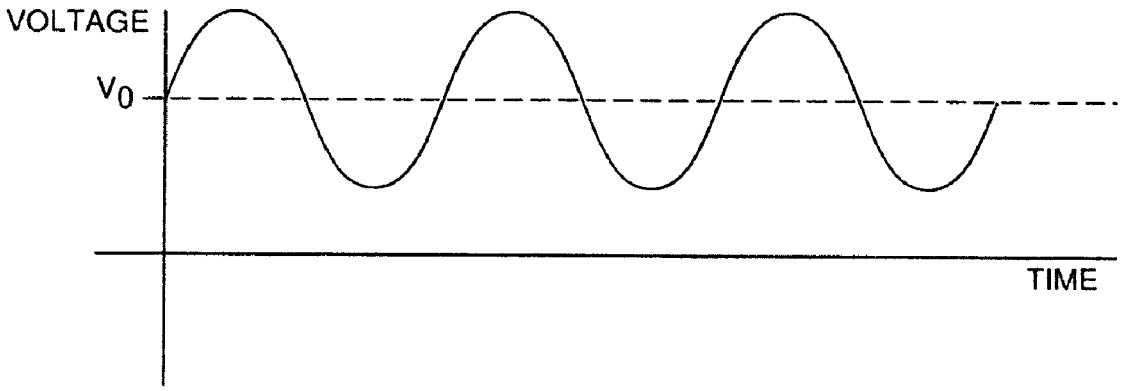
FIG. 6B is a graphical representation of an AC current with a DC offset according to one embodiment.

In one embodiment, the AC current includes a DC offset. The DC offset provides the electrical bias necessary to carry the toner from the photoconductor drum 14 to the ITM belt 24. FIG. 6A illustrates a graphical representation of an AC current with no DC offset. Without the offset, the effective bias voltage seen by the toner over a period of time may be zero. Consequently, there may be little or no toner transfer to the ITM belt 24 even though the AC current mechanically loosened the toner on the photoconductor drum 14. In contrast, FIG. 6B graphically illustrates an AC current with a DC offset indicated as $V_o$. In this embodiment, the oscillations of the AC current help to loosen the mechanical bonds of the toner particles on the photoconductive drum 14, and the DC offset provides the electrical bias to transfer the toner to the ITM belt 24. While FIGS. 6A and 6B illustrate the waveform of the AC current as a sine wave, it would be apparent to one skilled in the art that other waveforms may be used with the present application. For example, the waveform of one embodiment could include a square wave with a duty cycle varied, or the duty cycle may be offset to the square wave.

FIG. 6B illustrates one embodiment where the DC offset $V_o$ is greater than the amplitude of the AC current. In other embodiments, the DC offset $V_o$ may be less than the amplitude, or even equal to the amplitude. The amount of both the amplitude of the AC current and the DC offset $V_o$ may be adjusted to minimize print defects.

Figure 7:
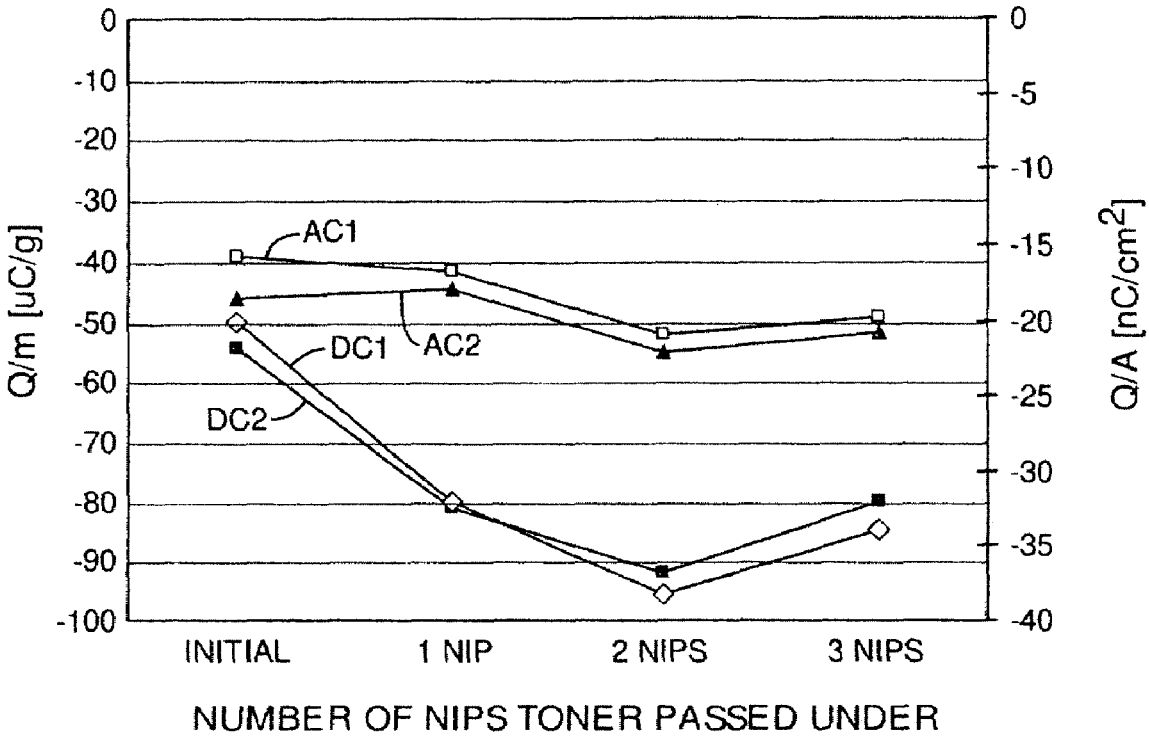
FIG. 7 is a graphical representation of toner charge buildup after passing under downstream nips according to one embodiment.

The magnitude of the DC offset $V_o$ may be less than the voltage needed for the transfer operation of the prior art image transfer station 30 illustrated in FIG. 2. The lower DC voltage results in less charge buildup in the toner image on the ITM belt 24 as the toner image passes through upstream image transfer stations 30. In addition, the AC current has little effect on toner charge buildup. The effect on toner charge buildup of one embodiment of the present application is illustrated in FIG. 7, wherein the units of graphs AC1 and DC2 are Q/A, and the units of graphs AC2 and DC1 are Q/m. The desired charge on the toner entering the secondary transfer location 22 for the image forming device represented in FIG. 7 is about −45 uC/g. Toner transfer using AC current with a DC offset (graphs AC1 and AC2) shows only a slight charge buildup and then a bounce back close to the desired value after the third transfer nip. However, toner transfer using only DC current (graphs DC1 and DC2) shows a larger charge buildup and, even after the bounce back after the third transfer nip, is nearly twice the desired value.

Embodiments of the present application lend themselves to a wide range of AC current amplitudes and frequencies. In one embodiment, the frequency ranges from about 100 Hz to about 2 kHz. In one embodiment, the frequency is 500 Hz. The amplitude (voltage) may vary with the surface resistivity of the ITM belt 24. In one embodiment, the amplitude varies directly with surface resistivity, such that lower resistivities may require a lower voltage and higher resistivities may require higher voltages. In one embodiment, the amplitude ranges from about 100 V peak-to-peak to about 2500 V peak-to-peak. In one embodiment, the amplitude ranges from about 500 V peak-to-peak to about 1200 V peak-to-peak. In one embodiment where a DC offset is used, the AC voltage is about 700 V peak-to-peak and the DC offset is about 300 V. In one embodiment, the AC voltage is about 500 V peak-to-peak and the DC offset is 500 V. In other embodiments, the amplitude ranges from 100 percent AC voltage to 100 percent DC voltage.

In addition to the lateral offset L between the photoconductor drum 14 and the transfer roller 34, there may also be a height offset H as illustrated in FIG. 4. The height offset H is defined as the vertical distance (e.g., generally orthogonal to the direction of the lateral offset L or the direction of travel of the ITM belt 24) measured between the point on the photoconductor drum 14 in contact with the ITM belt 24 and the point on the transfer roller 34 in contact with the ITM belt 24. More specifically, each contact point defines a plane within the ITM belt 24, these planes being parallel to one another. The height offset H is the distance separating the planes. The height offset H maintains contact between the ITM belt 24 and the photoconductor drum 14 and forms the transfer nip 46. The transfer nip 46 promotes adequate toner transfer to the ITM belt 24. In addition, the height offset H maintains continuous contact between the ITM belt 24 and the transfer roller 34 which helps prevent electrical arcing between ITM belt 24 and the transfer roller 34.

The transfer nip 46 may be formed by slightly changing a direction of travel of the ITM belt 24 at the points where the ITM belt 24 contacts the photoconductor drum 14 and the transfer roller 34. As illustrated in FIG. 4, the ITM belt 24 is in a generally horizontal orientation prior to the photoconductor drum 14. At the point of contact with the photoconductor drum 14, the direction of travel is altered slightly toward vertical, thus forming the transfer nip 46. The ITM belt 24 changes direction again at the transfer roller 34. The directional change may be opposite the change at the photoconductor drum 14 and returns the ITM belt 24 to an essentially horizontal orientation.

In one embodiment, the lateral offset L is adjustable. Varying the lateral offset L varies the volume of the section 24B of the ITM belt 24 that the current passes through between the transfer roller 34 and the photoconductor drum 14. The variable lateral offset L allows a wider range of transfer voltages to be used than with a fixed lateral offset L. For example, the ITM belt 24 may be constructed of a material with a high surface resistivity, and a high transfer voltage may be desirable to assure adequate toner transfer.

FIGS. 1, 4, 5A, and 5B each illustrate the image forming device 10 as having a horizontal architecture. It would be readily apparent to one skilled in the art that the embodiments of the present application may be used with image forming devices 10 utilizing a vertical architecture with equal effect.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner transfer apparatus in an image forming device, comprising:

a transfer belt;

a first roller adapted to receive a toner image and transfer the toner image to the transfer belt, the toner image including a first electrical charge; and a second roller able to conduct an electrical current;

the first roller positioned on a first side of the transfer belt and in contact with the transfer belt at a first area, the second roller positioned on a second side of the belt and in continuous contact with the transfer belt at a second area, the first and second areas offset from one another by a predetermined distance such that a line drawn from a center point on a longitudinal axis of the first roller to a center point on a longitudinal axis of the second roller intersects the transfer belt at a point further downstream than a most downstream point of the transfer belt in contact with the first roller, a line on the first roller in the first area in contact with the transfer belt that is substantially parallel to the longitudinal axis of the first roller being substantially in the same horizontal plane as the longitudinal axis of the second roller, the predetermined distance defining a section of the transfer belt between the first and second areas, the section having a resistivity such that an electrical field develops within the section of the transfer belt with a second electrical charge, the second electrical charge being more positively charged than the first electrical charge such that the toner image transfers from the first roller to the transfer belt.

2. The apparatus of claim 1, wherein the second roller comprises an essentially non-compressible conductive material.

3. The apparatus of claim 1, wherein the second roller comprises a uniform cross-section composition.

4. The apparatus of claim 1, wherein the first area defines a first plane in the transfer belt and the second area defines a second plane in the transfer belt, the first plane spaced apart from the second plane in a direction essentially orthogonal to a direction of travel of the transfer belt from the first roller to the second roller.

5. The apparatus of claim 4, wherein the spaced apart planes position the transfer belt in contact with the first roller.

6. The apparatus of claim 1, wherein the power supply is operative to produce an AC current.

7. The apparatus of claim 1, wherein the power supply is operative to produce an AC current with a DC offset.

8. A toner transfer apparatus in a toner image in an image forming device, comprising:

a transfer belt to receive a toner image;

a first roller including the toner image positioned on a first side of the transfer belt and a second roller positioned on a second side of the transfer belt, one of the first and second rollers offset downstream from the other roller by a predetermined distance such that a line drawn from a center point on a longitudinal axis of the other roller to a center point on a longitudinal axis of the downstream roller intersects the transfer belt at a point further downstream than a most downstream point of the transfer belt in contact with the other roller, a line defined along the other roller at a location of contact with the transfer belt and substantially in parallel with a longitudinal axis of the other roller being substantially in a same horizontal plane as a longitudinal axis of the downstream roller; and at least one power supply operative to provide a voltage differential across the first and second rollers using AC current;

the predetermined distance defining a section of the transfer belt, the section having a resistivity of the section such that an electrical field is created within the section due to the voltage differential to transfer the toner image from the first roller to the transfer belt.

9. The apparatus of claim 8, wherein the at least one power supply includes an AC current output with a DC offset.

10. The apparatus of claim 9, wherein an amount of the DC offset is dependent upon a surface resistivity of the transfer belt.

11. The apparatus of claim 8, wherein the first roller contacts the transfer belt at a first point and the second roller contacts the transfer belt at a second point, the predetermined distance being a length from the first point to the second point in a direction of travel of the transfer belt, the predetermined distance being adjustable.

12. The apparatus of claim 8, wherein the second roller comprises a uniform cross-sectional composition.

13. The apparatus of claim 8, wherein the first roller is a photoconductor drum.

14. The apparatus of claim 12, wherein the second roller is a transfer roller operative to produce an electrical field within the transfer belt to transfer the toner image from the photoconductor drum to the transfer belt.

15. A method of transferring toner in an image forming device, comprising positioning a first roller on a first side of a transfer belt;

positioning a second roller on a second side of the transfer belt;

positioning the second roller downstream from the first roller such that the first roller and the second roller are laterally spaced-apart by a predetermined distance, a substantially horizontal line drawn from where the first roller contacts the transfer belt intersects a center point of the second roller, the second roller contacts the transfer belt at all points further downstream than a most downstream point of the transfer belt in contact with the first roller;

electrically biasing a portion of an outer surface of the first roller to form a latent image thereon;

developing the latent image to form a toner image on the outer surface;

electrically biasing the second roller with an AC current;

creating an electrical field in a section of the transfer belt between the first roller and the second roller; and transferring the toner image from the first roller to the section of the transfer belt.

16. The method of claim 15, wherein electrically biasing the second roller further comprises electrically biasing the second roller with an AC current including a DC offset, a voltage of the DC offset being less than an amplitude of the AC current.

17. The method of claim 15, wherein electrically biasing the second roller further comprises electrically biasing the second roller with an AC current including a DC offset, a voltage of the DC offset being greater than or equal to an amplitude of the AC current.

18. The method of claim 15 wherein electrically biasing the second roller further comprises operatively connecting at least one power supply to the second roller and generating an electrical charge therein, the second roller constructed of a uniform conductive metallic composition.

19. The method of claim 15, further comprising urging the transfer belt into contact with the first roller by offsetting in a direction essentially orthogonal to a direction of travel of the transfer belt at a first point where the first roller contacts the transfer belt and a second point where the second roller contacts the transfer belt.

20. A toner transfer apparatus in a toner image in an image forming device, comprising:

a transfer belt to receive a toner image;

a first roller including the toner image positioned on a first side of the transfer belt and a second roller positioned on a second side of the transfer belt, a substantially horizontal line drawn from where the first roller contacts the transfer belt passes through a center point of the second roller, one of the first and second rollers offset downstream from the other roller by a predetermined distance along a direction of travel of the transfer belt that is greater than a sum of a radius of the first roller and a radius of the second roller; and at least one power supply operative to provide a voltage differential across the first and second rollers using AC current;

the predetermined distance defining a section of the transfer belt, a resistivity of the section creates an electrical field within the section due to the voltage differential to transfer the toner image from the first roller to the transfer belt.

* * * * *